US011377963B2

(12) United States Patent
Webster et al.

(10) Patent No.: US 11,377,963 B2
(45) Date of Patent: Jul. 5, 2022

(54) COMPONENT FOR A TURBINE ENGINE WITH A CONDUIT

(71) Applicant: GENERAL ELECTRIC COMPANY, Schenectady, NY (US)

(72) Inventors: Zachary Daniel Webster, Cincinnati, OH (US); Gregory Terrence Garay, West Chester, OH (US); Xi Yang, Mason, OH (US); Tingfan Pang, West Chester, OH (US); Steven Robert Brassfield, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/183,627

(22) Filed: Feb. 24, 2021

(65) Prior Publication Data

US 2021/0180459 A1 Jun. 17, 2021

Related U.S. Application Data

(63) Continuation of application No. 16/120,758, filed on Sep. 4, 2018, now Pat. No. 10,968,750.

(51) Int. Cl.
*F01D 5/18* (2006.01)

(52) U.S. Cl.
CPC ..... *F01D 5/186* (2013.01); *F05D 2220/323* (2013.01); *F05D 2240/12* (2013.01); *F05D 2240/30* (2013.01); *F05D 2240/81* (2013.01); *F05D 2250/75* (2013.01); *F05D 2260/202* (2013.01)

(58) Field of Classification Search
CPC ..... F01D 5/186; F01D 9/065; F01D 5/187; F01D 5/18; F05D 2220/323; F05D 2240/12; F05D 2240/30; F05D 2240/81; F05D 2250/75; F05D 2260/602; Y02T 50/60
See application file for complete search history.

(56) References Cited

U.S. PATENT DOCUMENTS

| | | | |
|---|---|---|---|
| 2,812,157 | A | 11/1957 | Turunen et al. |
| 2,919,549 | A | 1/1960 | Haworth et al. |
| 3,748,060 | A | 7/1973 | Hogoson et al. |
| 4,381,173 | A | 4/1983 | Freling |
| 6,000,908 | A | 12/1999 | Bunker |
| 6,431,833 | B2 | 8/2002 | Jones |
| 6,554,575 | B2 | 4/2003 | Leeke et al. |
| 8,342,803 | B2 | 1/2013 | Grohens et al. |
| 8,667,682 | B2 | 3/2014 | Lee et al. |
| 9,366,143 | B2 | 6/2016 | Lee et al. |
| 9,528,377 | B2 | 12/2016 | Fedor et al. |

(Continued)

FOREIGN PATENT DOCUMENTS

| | | | |
|---|---|---|---|
| CN | 1408988 | A | 4/2003 |
| CN | 101532399 | A | 9/2009 |
| CN | 107084050 | A | 8/2017 |

*Primary Examiner* — Aaron R Eastman
(74) *Attorney, Agent, or Firm* — McGarry Bair PC

(57) ABSTRACT

An apparatus and method for cooling a component for a turbine engine which generates a hot gas flow and provides a cooling fluid flow, the component comprising a body having an outer surface, at least a portion of which is exposed to the hot gas flow to define a hot surface, a cooling cavity located within the body and fluidly coupled to the cooling fluid flow and a pin located within the cooling cavity and defining a cooling hole.

20 Claims, 5 Drawing Sheets

(56) References Cited

U.S. PATENT DOCUMENTS

| | | | | |
|---|---|---|---|---|
| 2012/0107134 | A1 | 5/2012 | Harris, Jr. et al. | |
| 2013/0171004 | A1 | 7/2013 | Ellis et al. | |
| 2013/0230394 | A1* | 9/2013 | Ellis | F01D 5/187 416/97 R |
| 2015/0152735 | A1 | 6/2015 | Molter et al. | |
| 2016/0208705 | A1 | 7/2016 | Slavens et al. | |
| 2016/0305254 | A1 | 10/2016 | Snyder et al. | |
| 2016/0333702 | A1 | 11/2016 | Slavens et al. | |
| 2017/0145923 | A1 | 5/2017 | Spangler et al. | |
| 2017/0234225 | A1 | 8/2017 | Bunker et al. | |
| 2018/0016915 | A1 | 1/2018 | Osborne et al. | |

* cited by examiner

COMPONENT FOR A TURBINE ENGINE WITH A CONDUIT

CROSS REFERENCE TO RELATED APPLICATION

This application is a continuation of U.S. patent application Ser. No. 16/120,758 filed Sep. 4, 2018, which is incorporated herein in its entirety.

BACKGROUND OF THE INVENTION

Turbine engines, and particularly gas or combustion turbine engines, are rotary engines that extract energy from a flow of combusted gases passing through the engine onto a multitude of rotating turbine blades.

Engine efficiency increases with temperature of combustion gases. However, the combustion gases heat the various components along their flow path, which in turn requires cooling thereof to achieve a long engine lifetime. Typically, the hot gas path components are cooled by bleeding air from the compressor. This cooling process reduces engine efficiency, as the bled air is not used in the combustion process.

Turbine engine cooling art is mature and is applied to various aspects of cooling circuits and features in the various hot gas path components. For example, the combustor includes radially outer and inner liners, which require cooling during operation. Turbine nozzles include hollow vanes supported between outer and inner bands, which also require cooling. Turbine rotor blades are hollow and typically include cooling circuits therein, with the blades being surrounded by turbine shrouds, which also require cooling. The hot combustion gases are discharged through an exhaust which may also be lined, and suitably cooled.

In all of these exemplary turbine engine components, thin metal walls of high strength superalloy metals are typically used for enhanced durability while minimizing the need for cooling thereof. Various cooling circuits and features are tailored for these individual components in their corresponding environments in the engine. These components typically include common rows of film cooling holes.

BRIEF DESCRIPTION OF THE INVENTION

In one aspect the disclosure relates to an airfoil an airfoil for a turbine engine which generates a hot gas flow and provides a cooling fluid flow, the airfoil comprising a platform having an outer surface, at least a portion of which is exposed to the hot gas flow to define a hot surface; a cooling cavity located within the platform extending between a base wall and an outer wall to define a radial direction, the cooling cavity fluidly coupled to the cooling fluid flow; and a conduit defining an interior cooling passage extending into the cooling cavity between an inlet fluidly coupled to a clean portion of the cooling fluid flow proximate the base wall and an outlet fluidly coupled to the hot surface.

In another aspect the disclosure relates to a component for a turbine engine which generates a hot gas flow and provides a cooling fluid flow, the component comprising a body having an outer surface, at least a portion of which is exposed to the hot gas flow to define a hot surface; a cooling cavity located within the body extending between a base wall and an outer wall to define a radial direction, the cooling cavity fluidly coupled to the cooling fluid flow; and a conduit extending into the cooling cavity between at least one inlet fluidly coupled to a clean portion of the cooling fluid flow proximate the base wall and at least one outlet fluidly coupled to the hot surface.

In yet another aspect, the disclosure relates to a method for cooling a component with a cooling cavity, the method comprising flowing a cooling fluid flow through a conduit extending between an inlet and an outlet of a hollow pin located within the cooling cavity; ducting a clean portion of the cooling fluid flow proximate an interior surface of the cooling cavity; and emitting the cooling fluid flow through the outlet onto a heated surface.

DESCRIPTION OF EMBODIMENTS OF THE INVENTION

Figure 1:
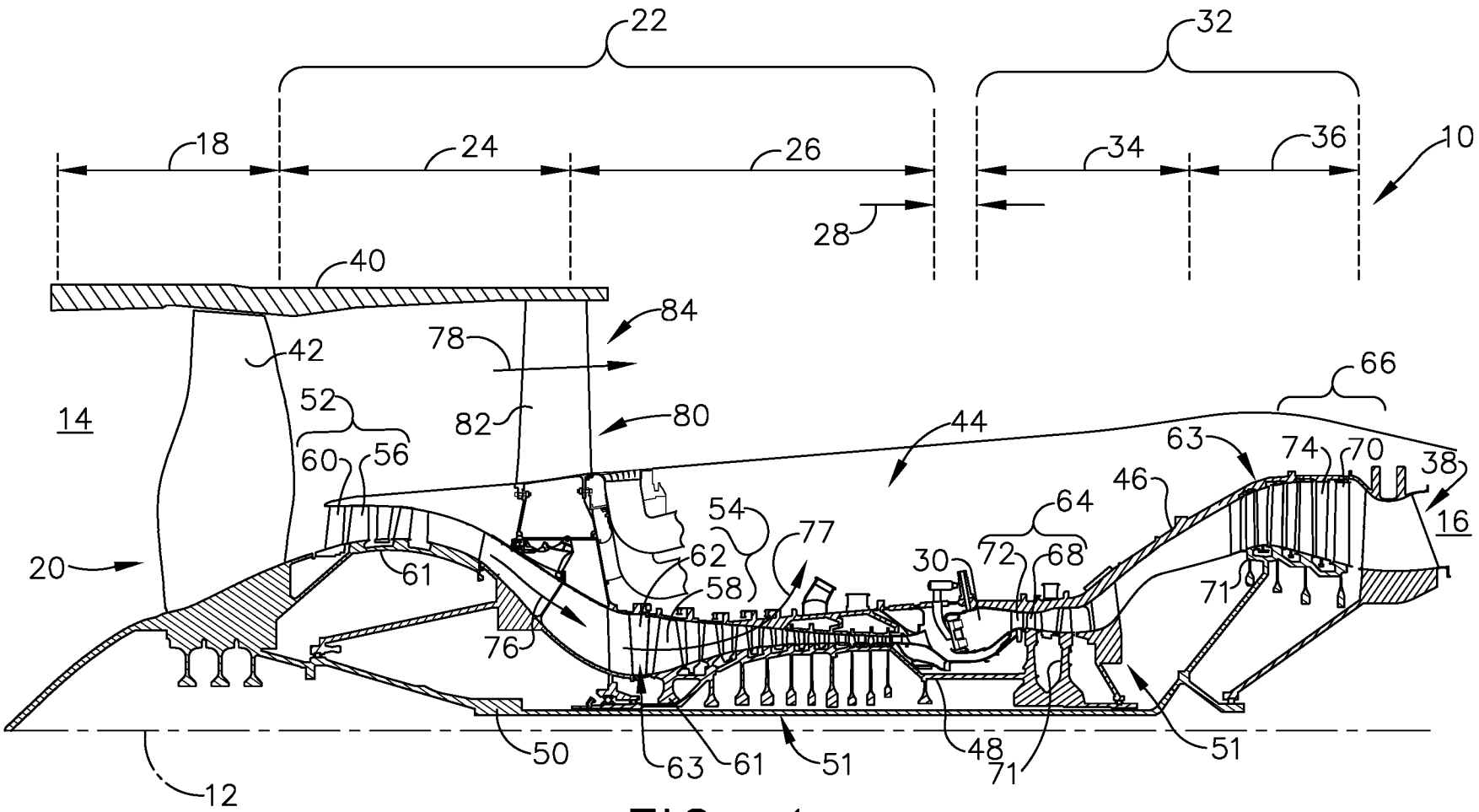
FIG. 1 is a schematic cross-sectional diagram of a turbine engine for an aircraft.

Aspects of the disclosure described herein are directed to the formation of a hole such as a cooling hole in an engine component such as an airfoil. For purposes of illustration, the aspects of the disclosure discussed herein will be described with respect to the platform portion of a blade. It will be understood, however, that the disclosure as discussed herein is not so limited and may have general applicability within an engine, including compressors, as well as in non-aircraft applications, such as other mobile applications and non-mobile industrial, commercial, and residential applications.

As used herein, the term "forward" or "upstream" refers to moving in a direction toward the engine inlet, or a component being relatively closer to the engine inlet as compared to another component. The term "aft" or "downstream" used in conjunction with "forward" or "upstream" refers to a direction toward the rear or outlet of the engine relative to the engine centerline. Additionally, as used herein, the terms "radial" or "radially" refer to a dimension extending between a center longitudinal axis of the engine and an outer engine circumference. Furthermore, as used herein, the term "set" or a "set" of elements can be any number of elements, including only one.

All directional references (e.g., radial, axial, proximal, distal, upper, lower, upward, downward, left, right, lateral, front, back, top, bottom, above, below, vertical, horizontal, clockwise, counterclockwise, upstream, downstream, aft, etc.) are only used for identification purposes to aid the reader's understanding of the present disclosure, and do not create limitations, particularly as to the position, orientation, or use of the disclosure. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. Furthermore it should be understood that the term cross section or cross-sectional as used herein is referring to a section taken orthogonal to the centerline and to the general coolant flow direction in the hole. The exemplary drawings are for purposes of illustration only and the dimensions, positions, order and relative sizes reflected in the drawings attached hereto can vary.

Referring to FIG. 1, an engine 10 has a generally longitudinally extending axis or centerline 12 extending forward 14 to aft 16. The engine 10 includes, in downstream serial flow relationship, a fan section 18 including a fan 20, a compressor section 22 including a booster or low pressure (LP) compressor 24 and a high pressure (HP) compressor 26, a combustion section 28 including a combustor 30, a turbine section 32 including a HP turbine 34, and a LP turbine 36, and an exhaust section 38.

The fan section 18 includes a fan casing 40 surrounding the fan 20. The fan 20 includes a plurality of fan blades 42 disposed radially about the centerline 12. The HP compressor 26, the combustor 30, and the HP turbine 34 form a core 44 of the engine 10, which generates combustion gases. The core 44 is surrounded by core casing 46, which can be coupled with the fan casing 40.

A HP shaft or spool 48 disposed coaxially about the centerline 12 of the engine 10 drivingly connects the HP turbine 34 to the HP compressor 26. A LP shaft or spool 50, which is disposed coaxially about the centerline 12 of the engine 10 within the larger diameter annular HP spool 48, drivingly connects the LP turbine 36 to the LP compressor 24 and fan 20. The spools 48, 50 are rotatable about the engine centerline and couple to a plurality of rotatable elements, which can collectively define a rotor 51.

The LP compressor 24 and the HP compressor 26 respectively include a plurality of compressor stages 52, 54, in which a set of compressor blades 56, 58 rotate relative to a corresponding set of static compressor vanes 60, 62 (also called a nozzle) to compress or pressurize the stream of fluid passing through the stage. In a single compressor stage 52, 54, multiple compressor blades 56, 58 can be provided in a ring and can extend radially outwardly relative to the centerline 12, from a blade platform to a blade tip, while the corresponding static compressor vanes 60, 62 are positioned upstream of and adjacent to the rotating blades 56, 58. It is noted that the number of blades, vanes, and compressor stages shown in FIG. 1 were selected for illustrative purposes only, and that other numbers are possible.

The blades 56, 58 for a stage of the compressor mount to a disk 61, which mounts to the corresponding one of the HP and LP spools 48, 50, with each stage having its own disk 61. The vanes 60, 62 for a stage of the compressor mount to the core casing 46 in a circumferential arrangement.

The HP turbine 34 and the LP turbine 36 respectively include a plurality of turbine stages 64, 66, in which a set of turbine blades 68, 70 are rotated relative to a corresponding set of static turbine vanes 72, 74 (also called a nozzle) to extract energy from the stream of fluid passing through the stage. In a single turbine stage 64, 66, multiple turbine blades 68, 70 can be provided in a ring and can extend radially outwardly relative to the centerline 12, from a blade platform to a blade tip, while the corresponding static turbine vanes 72, 74 are positioned upstream of and adjacent to the rotating blades 68, 70. It is noted that the number of blades, vanes, and turbine stages shown in FIG. 1 were selected for illustrative purposes only, and that other numbers are possible.

The blades 68, 70 for a stage of the turbine can mount to a disk 71, which is mounts to the corresponding one of the HP and LP spools 48, 50, with each stage having a dedicated disk 71. The vanes 72, 74 for a stage of the compressor can mount to the core casing 46 in a circumferential arrangement.

Complementary to the rotor portion, the stationary portions of the engine 10, such as the static vanes 60, 62, 72, 74 among the compressor and turbine section 22, 32 are also referred to individually or collectively as a stator 63. As such, the stator 63 can refer to the combination of non-rotating elements throughout the engine 10.

In operation, the airflow exiting the fan section 18 splits such that a portion of the airflow is channeled into the LP compressor 24, which then supplies pressurized air 76 to the HP compressor 26, which further pressurizes the air. The pressurized air 76 from the HP compressor 26 mixes with fuel in the combustor 30 where the fuel combusts, thereby generating combustion gases. The HP turbine 34 extracts some work from these gases, which drives the HP compressor 26. The HP turbine 34 discharges the combustion gases into the LP turbine 36, which extracts additional work to drive the LP compressor 24, and the exhaust gas is ultimately discharged from the engine 10 via the exhaust section 38. The driving of the LP turbine 36 drives the LP spool 50 to rotate the fan 20 and the LP compressor 24.

A portion of the pressurized airflow 76 can be drawn from the compressor section 22 as bleed air 77. The bleed air 77 can be drawn from the pressurized airflow 76 and provided to engine components requiring cooling. The temperature of pressurized airflow 76 entering the combustor 30 is significantly increased. As such, cooling provided by the bleed air 77 is necessary for operating of such engine components in the heightened temperature environments.

A remaining portion of the airflow 78 bypasses the LP compressor 24 and engine core 44 and exits the engine 10 through a stationary vane row, and more particularly an outlet guide vane assembly 80, comprising a plurality of airfoil guide vanes 82, at the fan exhaust side 84. More specifically, a circumferential row of radially extending airfoil guide vanes 82 are utilized adjacent the fan section 18 to exert some directional control of the airflow 78.

Some of the air supplied by the fan 20 can bypass the engine core 44 and be used for cooling of portions, especially hot portions, of the engine 10, and/or used to cool or power other aspects of the aircraft. In the context of a turbine engine, the hot portions of the engine are normally downstream of the combustor 30, especially the turbine section 32, with the HP turbine 34 being the hottest portion as it is directly downstream of the combustion section 28. Other sources of cooling fluid can be, but are not limited to, fluid discharged from the LP compressor 24 or the HP compressor 26.

Figure 2:
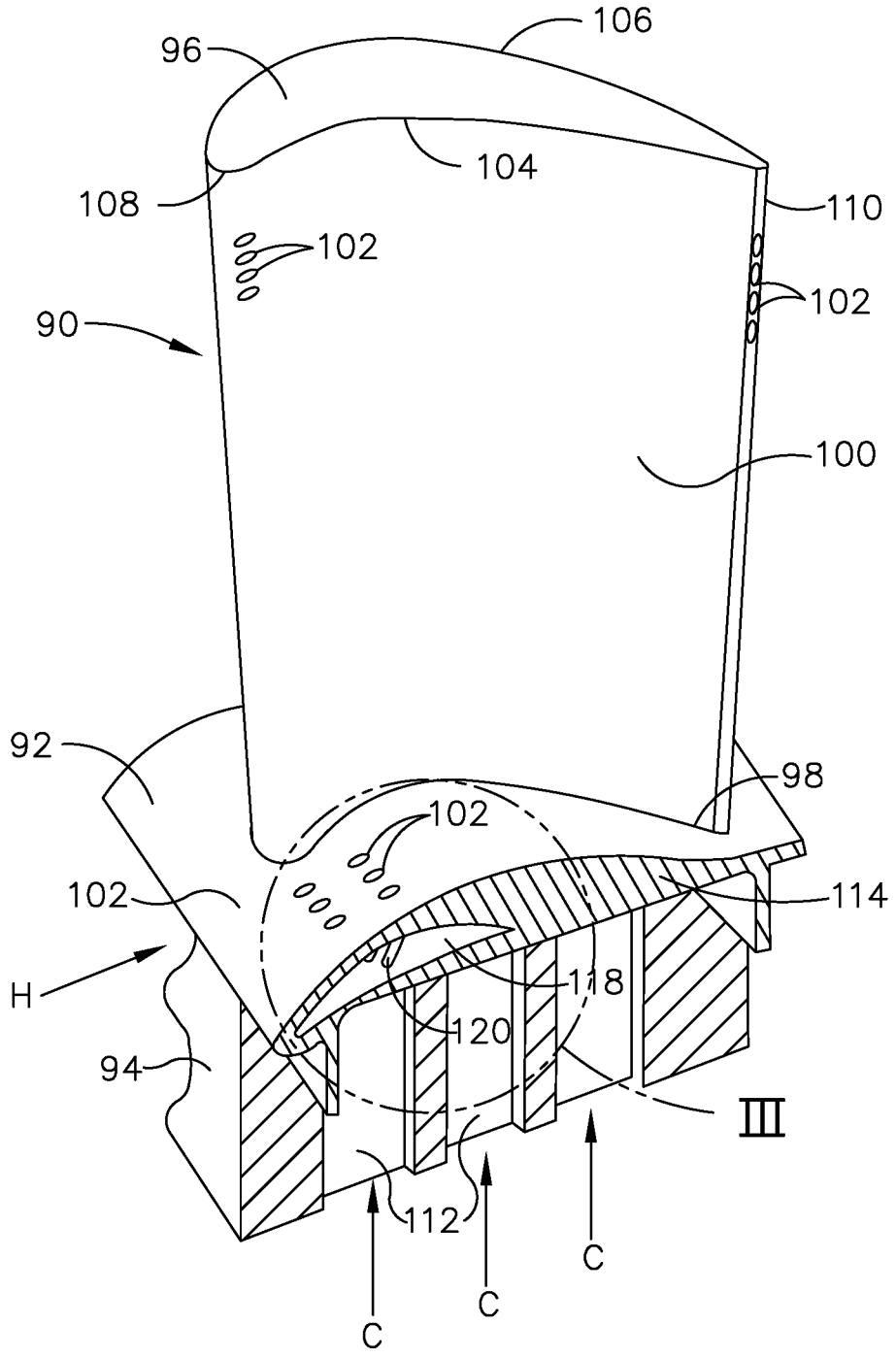
FIG. 2 is an isometric view of an airfoil for the turbine engine of FIG. 1 in the form of a blade and having a platform with cooling holes.

FIG. 2 is a perspective view of an example of an engine component illustrated as an airfoil 90, a platform 92, and a dovetail 94. The airfoil 90 is shown as one of the rotating blades 68, but can alternatively be a stationary vane, such as the vane 72 of FIG. 1, while any suitable engine component is contemplated. The airfoil 90 includes a tip 96 and a root 98, defining a span-wise direction there between. Additionally, the airfoil 90 includes a wall 100. A pressure side 104 and a suction side 106 are defined by the airfoil shape of the wall 100.

The airfoil 90 mounts to the platform 92 at the root 98. The platform 92 is shown in section, but can be formed as an annular band for mounting a plurality of airfoils 90. The airfoil 90 can fasten to the platform 92, such as welding or mechanical fastening, or can be integral with the platform 92 in non-limiting examples. According to an aspect of the disclosure herein, at least one cooling hole 102 is formed in an outer wall 101 of the platform 92. The at least one cooling hole 102 can be multiple cooling holes 102 as illustrated, and, by way of non-limiting example, can be located in the platform 92 on the pressure side 104 of the airfoil 90. The airfoil 90 further includes a leading edge 108 and a trailing edge 110, defining a chord-wise direction.

The dovetail 94 couples to the platform 92 opposite of the airfoil 90, and can be configured to mount to the disk 71, or rotor 51 of the engine 10 (FIG. 1), for example. In one alternative example, the platform 92 can be formed as part of the dovetail 94. The dovetail 94 can include one or more inlet passages 112, illustrated as three inlet passages 112. It is contemplated that the inlet passages 112 are fluidly coupled to the cooling holes 102 to provide a cooling fluid flow (C) for cooling the platform 92. In another non-limiting example, the inlet passages 112 can provide the cooling fluid flow (C) to an interior of the airfoil 90 for cooling of the airfoil 90. It should be appreciated that the dovetail 94 is shown in cross-section, such that the inlet passages 112 are housed within the body of the dovetail 94.

The platform 92 can define a body 114 having an outer surface 116 of the outer wall 101 exposed to a hot gas flow (H) to define a hot surface. A cooling cavity 118 can be located within the body 114 and be fluidly coupled to the cooling fluid flow (C) via, by way of non-limiting example some internal cooling passage or other cooling cavity not shown, such that the cooling fluid flow (C) flows within the cooling cavity 118. At least one hollow pin 120 can extend into the cooling cavity 118. The at least one hollow pin 120 can extend in a radial direction with respect to the engine centerline 12. The hollow pin 120 can be any conduit extending into the cooling cavity 118 and including a cooling passage.

Figure 3:
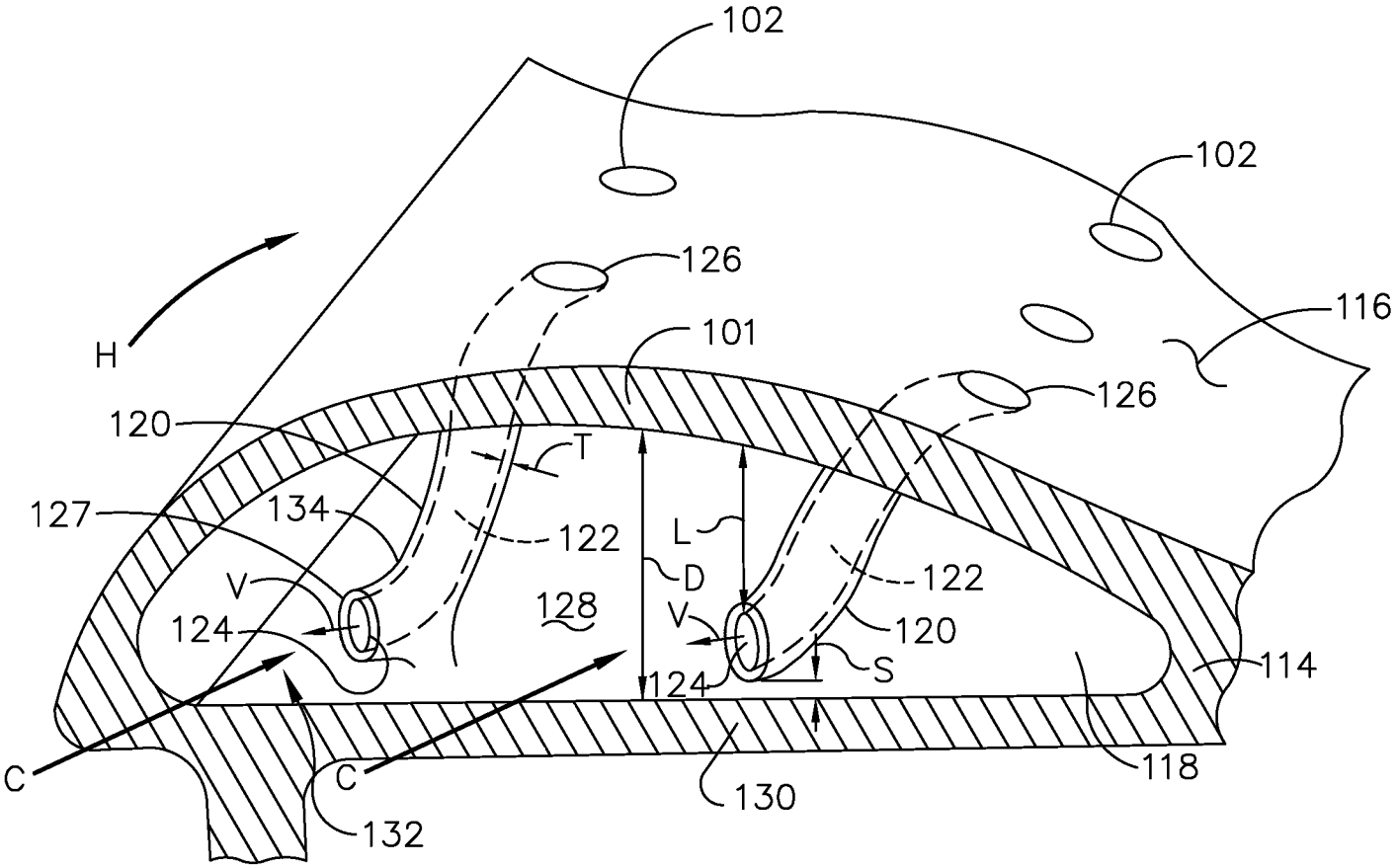
FIG. 3 is an enlarged cross-sectional perspective view of a portion of the platform with the cooling holes from FIG. 1 showing hollow pins within a cooling cavity according to an aspect of the disclosure.

FIG. 3 is an enlarged portion III of the platform 92 illustrating the cooling cavity 118 in more detail. It can more clearly be seen that the hollow pin 120 defines at least a portion of the cooling hole 102, specifically an interior cooling passage 122, illustrated in dashed line, extending between an inlet 124 and an outlet 126. While illustrated as an oval shape, the outlet 126 can be any suitable shape, including but not limited to racetrack, circular, rounded rectangular, or rounded triangular. The hollow pin 120 can further define a pin wall thickness (T) between 0.1 mm and 3 mm (0.005 to 0.1 inches), and preferably between 0.2 mm and 2 mm (0.01 to 0.05 inches). The thickness (T) is tailored to reduce weight while still enabling producibility and mechanical support. Furthermore, the thickness (T) enables convection cooling.

The inlet 124 can be provided on one side of the hollow pin 120, by way of non-limiting example on the end 127 of the hollow pin 120 as illustrated. The inlet 124 can be formed at any location of the hollow pin 120 proximate the cooling fluid flow (C) present in the cooling cavity 118. Proximate the cooling fluid flow (C) refers to locating the inlet 124 anywhere along the length of the hollow pin 120 such that the inlet 124 can receive cooling fluid flow (C). An interior surface 128 of the cooling cavity 118 is in contact with the cooling fluid flow (C) to define a cooled surface. The cooling cavity 118 forms a large internal convection area with the at least one hollow pin 120 forming a conduction path from the hot surface to a cooled surface within the cooling cavity 118.

At least a portion of the outer wall 101 at least partially defines the interior surface 128 such that the outer wall 101 extends between the interior surface 128 and the outer surface 116. A base wall 130 can further define the interior surface 128 and be radially spaced from the outer wall 101 a radial dimension (D) to further define the cooling cavity 118. The hollow pin 120 can be formed to extend from and be attached to both the base wall 130 and the outer wall 101. During operation centrifugal loads on the engine component cause dust to move away from the base wall 130 forming a clean region 132 of the cooling fluid flow (C) located along the interior surface 128 at the base wall 130. It is contemplated that the hollow pin 120 extends from the outer wall 101 towards the base wall 130 such that the inlet 124 is located proximate the clean region 132 of cooling fluid flow (C). The hollow pin 120 can extend radially into the cooling cavity 118 a length (L) less than the radial dimension (D). It should be understood that while illustrated as attached to the interior surface 128 in one of the hollow pins 120 illustrated, the hollow pin 120 can be a partial pin as illustrated in the other of the hollow pins 120 extending partially into the cooling cavity 118. In this case, the length (L) is less than the radial dimension (D) and spaced (S) from the interior surface 128 with no connection to the interior surface 128. When described as being proximate the cooling fluid flow (C), the inlet 124 can be touching the interior surface 128, or spaced from the interior surface (S). Dust accumulating away from the base wall 130 can leave a majority of the cooling cavity 118 free of dust and defining the clean region 132.

A bend 134 can be formed in the hollow pin 120 to enable a positioning of the inlet 124 toward the cooling fluid flow (C). While illustrated as one bend 134, it is contemplated that a plurality of bends can be formed in the hollow pin 120 at multiple locations to help orient the inlet toward the clean region 132. A vector (V) extending perpendicularly from a plane formed by the inlet 124 can align with the interior surface 128 to tailor inlet effects of the cooling fluid flow (C). It is also contemplated that the angle and orientation of the hollow pin 120 do not necessitate a bend 134 formed in the hollow pin 120.

Figure 4:
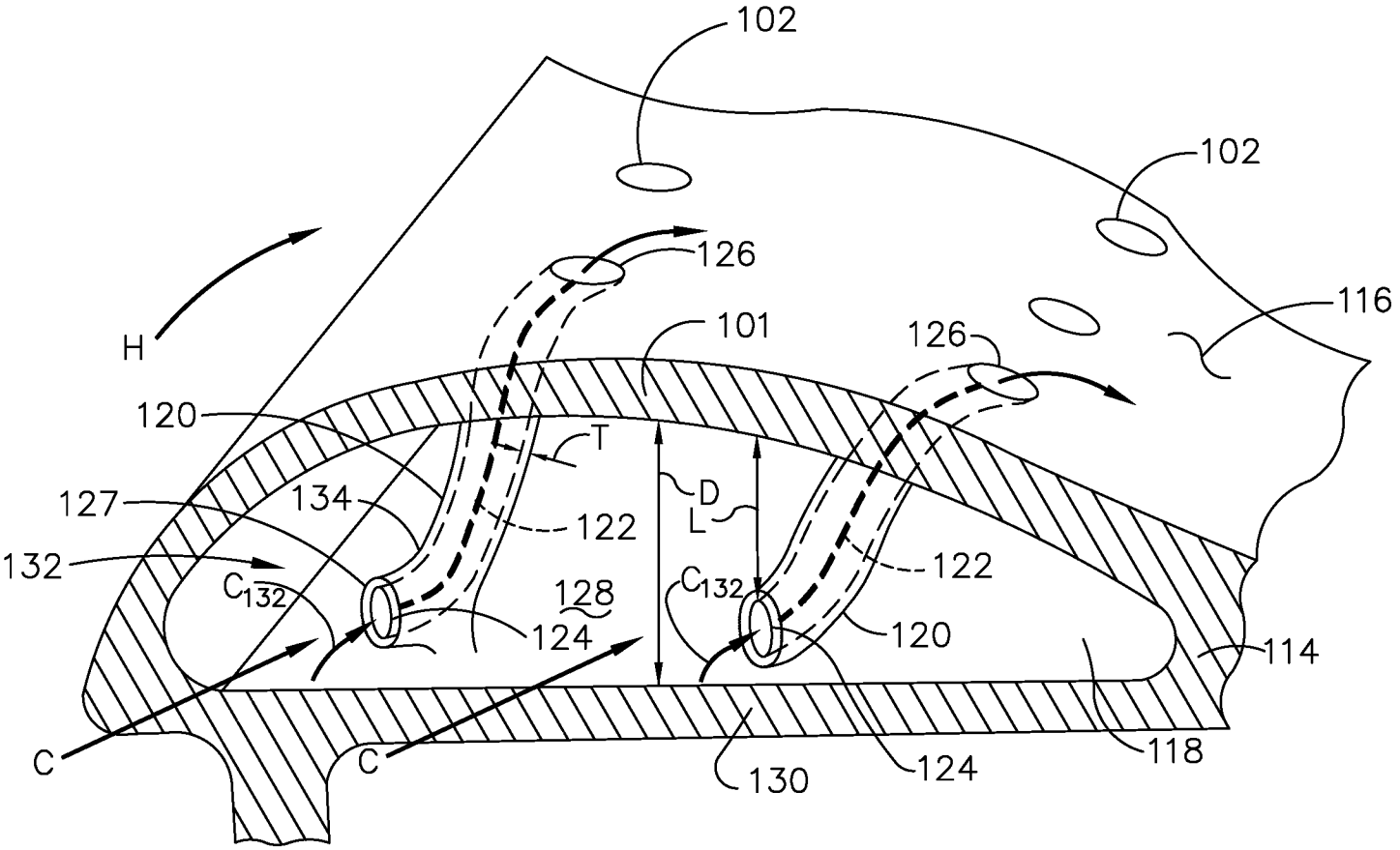
FIG. 4 is the enlarged cross-sectional perspective view of FIG. 3 illustrating the path of cooling fluid through the hollow pins.

Turning to FIG. 4, a method is illustrated for cooling the engine component using the cooling cavity 118 and hollow pin 120. The method includes flowing cooling fluid flow (C) through the cooling cavity 118 to supply the cooling fluid flow (C) to the interior cooling passage 122 that extends between the inlet 124 and the outlet 126. The method further includes emitting the cooling fluid flow (C) through the outlet 126 onto the heated surface, or outer surface 116, by way of non-limiting example, the outer surface 116 of the platform 92.

The method can include flowing the cooling fluid flow (C) from the cooling cavity 118 into the interior cooling passage via the inlet 124. The location of the inlet 124 can enable ducting a clean portion ($C_{132}$) of the cooling fluid flow (C) to the outer surface 116 from the clean region 132 proximate the interior surface 128 of the cooling cavity 118. The clean region 132 is located along the interior surface 128 radially inboard with respect to the cooling cavity 118.

Figure 5:
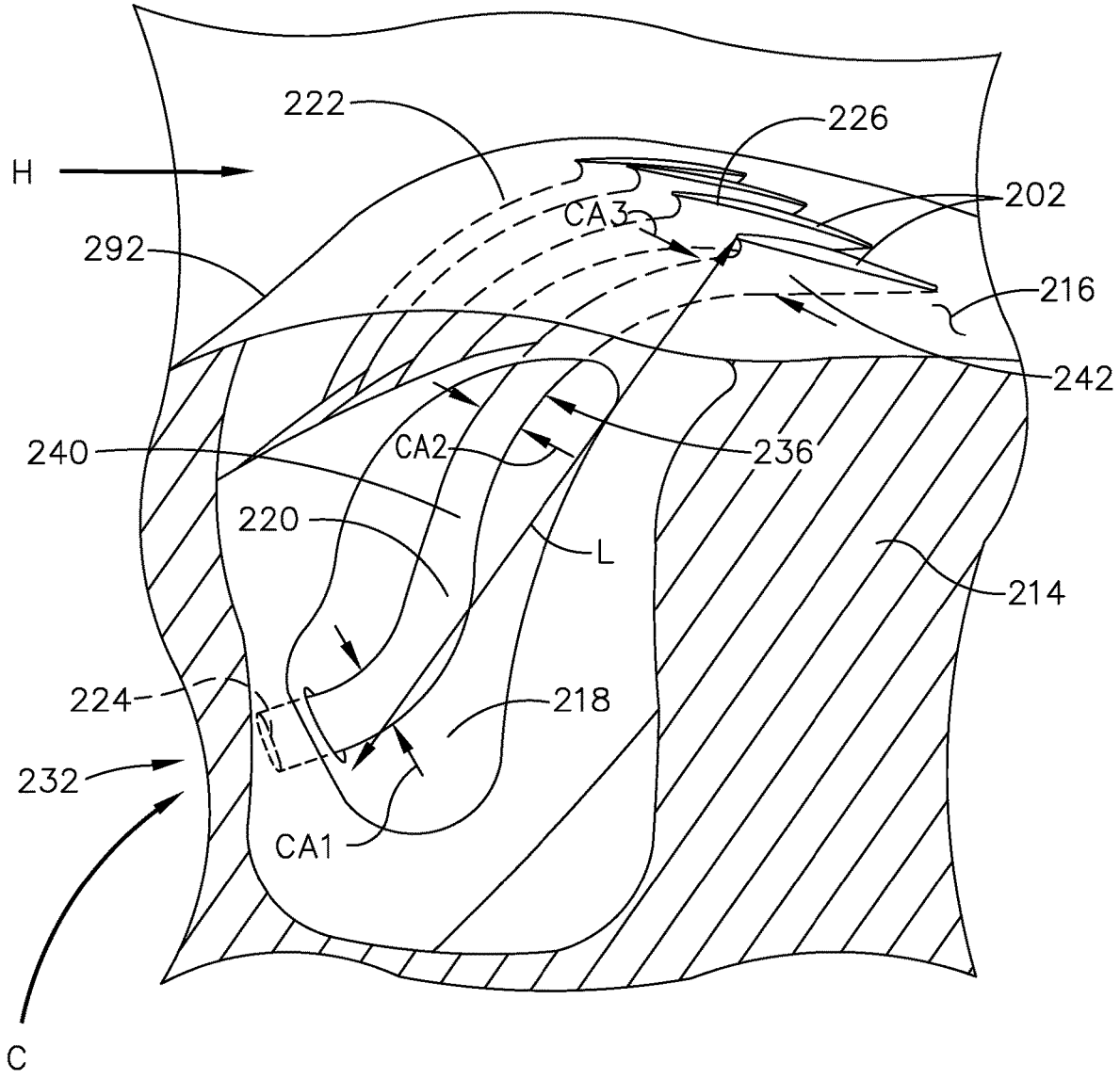
FIG. 5 is a variation of the hollow pins from FIG. 3 according to another aspect of the disclosure herein.

FIG. 5 illustrates a hollow pin 220 that can be formed in the component as described herein. The hollow pin 220 is similar to the hollow pin 120 therefore, like parts will be described with like numerals increased by 100, with it being understood that the description of the like parts of the hollow pin 120 applies to the hollow pin 220, unless otherwise noted.

The hollow pin 220 can extend through a cooling cavity 218 as illustrated. The hollow pin can define a cooling hole 202 having an interior cooling passage 222 terminating in an outlet 226. In an aspect of the disclosure herein an inlet 224, hidden by a body 214 of the component and illustrated in dashed line, as described previously can be located outside of the cooling cavity 218 and fluidly coupled to another source, by way of non-limiting example a cooling cavity located elsewhere and having a cooling fluid flow (C). The hollow pin 220 can have a substantially curved S-shape 236. An S-shape 236 can enable both an optimum inlet 224 location with respect to a clean region 232 of the cooling fluid flow (C), including when the clean region 232 is located outside of the cooling cavity 218.

It is contemplated that a first cross-sectional area (CA1) of the hollow pin 220 can decrease to a smaller second cross-sectional area (CA2) along a length (L) extending towards the outlet 226. The decrease in cross-sectional area can be a continuously decreasing cross-sectional area. It is also contemplated that the first cross-sectional area (CA1) can define a constant cross-sectional area for a portion of the length (L) of the hollow pin 220 and the second cross-sectional area (CA2) can define a constant cross-sectional area for another portion of the length (L) of the hollow pin 220. A decrease of any kind in cross-sectional area of the hollow pin 220 can coordinate with a change in cross-sectional area of the interior cooling passage 222 such that the cooling fluid (C) is accelerated through a narrower passage before being emitted onto an exterior surface 216 of a platform 292. The cross-sectional area can be any shape, including but not limited to circular or racetrack.

In one exemplary aspect of the disclosure herein, the internal cooling passage 222 can further include a metering section 240 having a circular cross section, though it could have any cross-sectional shape. The metering section 240 can be provided where the first cross-sectional area (CA1) decreases to the second cross-sectional area (CA2). The metering section can extend along the interior cooling passage and maintain a constant cross-sectional area. The metering section 240 defines the smallest, or minimum cross-sectional area of the interior cooling passage 222. It is also contemplated that the metering section 240 can have no length and is located at any portion of the interior cooling passage 222 where the cross-sectional area is the smallest. It is further contemplated that the metering section 240 can define the inlet 224 without extending into the interior cooling passage 222 at all. The interior cooling passage 222 can include multiple metering sections and is not limited to one as illustrated. The metering section 240 is for metering of the mass flow rate of the cooling fluid flow (C).

In another aspect of the disclosure herein, the interior cooling passage can define an increasing cross-sectional area (CA3) where at least a portion of the increasing cross-sectional area (CA3) defines a diffusing section 242 having a maximum cross-sectional area of the passage and terminating in the outlet 226. In some implementations the increasing cross-sectional area (CA3) is continuously increasing as illustrated. The diffusing section 242 enables an expansion of the cooling fluid (C) to form a wider and slower cooling film on the exterior 216 along the heated surface. The diffusing section 242 can be in serial flow communication with the metering section 240. It is alternatively contemplated that the cooling hole 202 have a minimal or no metering section 240, or that the diffusing section 242 extends along the entirety of the cooling hole 202. The S-shape 232 provides geometry necessary for a longer diffusing section 242 at the outlet 226.

The hollow pins as described herein can be formed using additive or advanced casting manufacturing technologies. By way of non-limiting example these technologies can include fused deposition modeling (FDM), VAT Photopolymerisation, Powder-bed fusion (PBF), material jetting, binder jetting, sheet lamination, or directed energy deposition (DED).

Radially extending hollow pins with embedded apertures in them enable specific durability and performance benefits for the platform as described herein. Optimal diffuser lengths are possible by utilizing the hollow pin for elongation of the diffusing portion of the cooling hole to provide higher film effectiveness. Additionally the presence of a hollow pin increases internal convection. Furthermore, sourcing low-dirt-count air mass from the bottom of the platform increases cooling effectiveness which increases hot gas path durability which results in reduced services costs & better SFC.

Turbine cooling is important in next generation architecture which includes ever increasing temperatures. Current cooling technology needs to expand to the continued increase in core temperature of the engine that comes with more efficient engine design. Optimizing cooling at the surface of engine components by designing more effective cooling hole geometry and placement enable more efficient engine designs.

It should be understood that while the description herein is related to an airfoil platform, it can have equal applicability in other engine components requiring cooling via cooling holes such as film cooling. One or more of the engine components of the engine 10 includes a film-cooled substrate, or wall, in which a film cooling hole, or hole, of the disclosure further herein may be provided. Some non-limiting examples of the engine component having a wall can include blades, vanes or nozzles, a combustor deflector, combustor liner, or a shroud assembly. Other non-limiting examples where film cooling is used include turbine transition ducts and exhaust nozzles.

It should be appreciated that application of the disclosed design is not limited to turbine engines with fan and booster sections, but is applicable to turbojets and turbo engines as well.

This written description uses examples to illustrate the disclosure as discussed herein, including the best mode, and also to enable any person skilled in the art to practice the disclosure as discussed herein, including making and using any devices or systems and performing any incorporated methods. The patentable scope of the disclosure as discussed herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An airfoil for a turbine engine which generates a hot gas flow and provides a cooling fluid flow, the airfoil comprising:

a platform having an outer surface, at least a portion of which is exposed to the hot gas flow to define a hot surface;

a cooling cavity located within the platform extending between a base wall and an outer wall to define a radial direction, the cooling cavity fluidly coupled to the cooling fluid flow; and a conduit defining an interior cooling passage extending into the cooling cavity between an inlet fluidly coupled to a clean portion of the cooling fluid flow proximate the base wall and an outlet fluidly coupled to the hot surface.

2. The airfoil of claim 1, wherein the airfoil is a rotating airfoil.

3. The airfoil of claim 2, wherein the inlet is located on one side of the conduit or an end of the conduit.

4. The airfoil of claim 1, wherein the conduit extends in a radial direction between the inlet and the outlet.

5. The airfoil of claim 4, wherein the conduit extends through the cooling cavity and the outer wall, and the inlet is located outside of the cooling cavity.

6. The airfoil of claim 1, wherein a cross-sectional area of the interior cooling passage changes between the inlet and the outlet.

7. A component for a turbine engine which generates a hot gas flow and provides a cooling fluid flow, the component comprising:

a body having an outer surface, at least a portion of which is exposed to the hot gas flow to define a hot surface;

a cooling cavity located within the body extending between a base wall and an outer wall to define a radial direction, the cooling cavity fluidly coupled to the cooling fluid flow; and a conduit extending into the cooling cavity between at least one inlet fluidly coupled to a clean portion of the cooling fluid flow proximate the base wall and at least one outlet fluidly coupled to the hot surface.

8. The component of claim 7, wherein the at least one inlet is located on a side of the conduit.

9. The component of claim 7, wherein the at least one inlet is located at an end of conduit.

10. The component of claim 7, wherein the conduit extends through the cooling cavity and the outer wall, and the at least one inlet is located outside of the cooling cavity.

11. The component of claim 7, wherein the cooling cavity has a radial dimension and the conduit extends into the cooling cavity a length less than the radial dimension.

12. The component of claim 7, wherein the component is a rotating component.

13. The component of claim 7, wherein a cross-sectional area of the conduit changes between the at least one inlet and the at least one outlet.

14. The component of claim 7, wherein the conduit further defines a wall thickness between 0.1 and 3 millimeters.

15. The component of claim 7, wherein the body is a platform of an airfoil.

16. A method for cooling an engine component with a cooling cavity, the method comprising:

flowing a cooling fluid flow through a conduit located within the cooling cavity, the conduit extending between an inlet and an outlet;

ducting a clean portion of the cooling fluid flow proximate an interior surface of the cooling cavity through the inlet; and emitting the clean portion of the cooling fluid flow through the outlet onto a heated surface.

17. The method of claim 16, further comprising moving dust away from a base wall defining at least a portion of the interior surface to define the clean portion of the cooling fluid flow.

18. The method of claim 17, wherein moving dust away comprises rotating the engine component to produce centrifugal loads on the engine component to separate flow into a dirty region and a clean region.

19. The method of claim 18, further comprising flowing the clean portion of the cooling fluid flow from the clean region through the conduit.

20. The method of claim 16, wherein emitting the clean portion of the cooling fluid flow onto a heated surface comprises emitting the clean portion of the cooling fluid flow onto an outer surface of an airfoil platform.

* * * * *